US009085025B2

(12) United States Patent
Fritzsche

(10) Patent No.: US 9,085,025 B2
(45) Date of Patent: Jul. 21, 2015

(54) SYSTEM FOR MARKING CONTAINERS

(71) Applicant: Ryan Fritzsche, San Diego, CA (US)

(72) Inventor: Ryan Fritzsche, San Diego, CA (US)

( * ) Notice: Subject to any disclaimer, the term of this patent is extended or adjusted under 35 U.S.C. 154(b) by 0 days.

(21) Appl. No.: 14/329,620

(22) Filed: Jul. 11, 2014

(65) Prior Publication Data

US 2015/0027195 A1 Jan. 29, 2015

Related U.S. Application Data

(60) Provisional application No. 61/859,685, filed on Jul. 29, 2013.

(51) Int. Cl.

| | |
|---|---|
| ***B21D 51/26*** | (2006.01) |
| ***B21D 22/02*** | (2006.01) |
| ***B21D 51/34*** | (2006.01) |
| ***B21D 15/04*** | (2006.01) |

(52) U.S. Cl.

CPC ..... *B21D 51/2607* (2013.01); *B21D 15/04* (2013.01); *B21D 22/02* (2013.01); *B21D 51/34* (2013.01)

(58) Field of Classification Search

CPC .... B21D 22/02; B21D 15/04; B21D 51/2607; B21D 51/34

USPC ..... 72/479

See application file for complete search history.

(56) References Cited

U.S. PATENT DOCUMENTS

| | | | | | |
|---|---|---|---|---|---|
| 806,111 | A | * | 12/1905 | Coppet | 101/110 |
| 3,739,662 | A | * | 6/1973 | Windelman et al. | 76/107.1 |
| D279,198 | S | | 6/1985 | Pedersen | |
| 5,313,885 | A | * | 5/1994 | Winston | 101/405 |
| 5,344,358 | A | | 9/1994 | Jantzen | |
| 5,799,525 | A | * | 9/1998 | Johnson et al. | 72/105 |
| 6,338,263 | B1 | * | 1/2002 | Obata et al. | 72/105 |
| 6,446,549 | B1 | | 9/2002 | Soucie et al. | |
| 2008/0134912 | A1 | | 6/2008 | Golan | |
| 2012/0138620 | A1 | | 6/2012 | Chapin | |
| 2012/0304694 | A1 | | 12/2012 | Derrig | |
| 2015/0027195 | A1 | * | 1/2015 | Fritzsche | 72/479 |

* cited by examiner

*Primary Examiner* — David B Jones

(74) *Attorney, Agent, or Firm* — Mark Wisnosky

(57) ABSTRACT

The invention comprises a means for providing customizable identification symbols to a metal container using a custom, portable tool for stamping the symbols onto the external surface of the container.

11 Claims, 12 Drawing Sheets

SYSTEM FOR MARKING CONTAINERS

CROSS-REFERENCE TO RELATED APPLICATIONS

This application claims priority to U.S. Provisional application 61/859,685 titled System for Marking Containers, Filed Jul. 29, 2013, by the same inventor.

BACKGROUND OF THE INVENTION

1. Technical Field

The present invention relates to means for providing visual identification of personal possessions. In particular, the present invention relates to a means for applying customizable identification symbols to a metal container.

2. Related Background Art

Often, at a party or in other social settings where people are mixing and mingling, numerous people are drinking various liquid refreshments. Many times, an individual must set his or her drink down momentarily intending to return to it later. Sometimes, either that person becomes unsure where the drink was placed, or finds that two or more similar appearing drinks have been left in an area, and it becomes difficult to tell to whom which drink belongs. In situations such as this it becomes possible for beverage containers to become mixed up. One person may end up drinking from another's container. Drinking from a beverage container previously used by another is generally considered to be impolite and is offensive to many people. Also, drinking from a beverage container previously used by another may result in the transmission of disease from the first user to the second user. Mixups can also occur after partially consumed beverages are stored in a refrigerator. The original beverage owner, after the lapse of some time, may be unable to identify the beverage which he placed within the refrigerator. Some respond to these mixups by discarding their partially consumed beverages. Others respond by consuming beverages which may have been previously partially consumed by others, thereby subjecting themselves to the risk of disease transmission.

Identification tags or labels are available for luggage, as well as for keys, books, and many other items of personal property. Some items, like books, can be directly written on to identify ownership thereof. However, there is a need in the art for a simple, easily applied identification symbol that a person may place on a beverage container to identify its owner, for their own reference as well as others. Preferably, such a beverage container identification symbol would be water resistant and require the application of no other materials to the container, to save on costs and to preserve resources.

DISCLOSURE OF THE INVENTION

The present invention provides a system for applying an identification symbol to a metal container, such as an aluminum can typically used to contain beer or soft drinks, to allow people to identify the ownership of a drink stored therein, and using a portable, customizable stamping tool. The tool is preferably constructed of metal or hard plastic and contains raised symbols or characters in mirror image corresponding to a custom identifier desired by a user. Additionally, the tool can be conveniently incorporated into personal articles such as cell phone covers and key fobs for ready use in social situations. When firmly pressed against the outside surface of a metal container the tool creates indentations in the external surface of the container resulting in a readable identifier comprising symbols or characters being stamped into the external surface of the container. The stamped identifier thereby uniquely identifies the container as belonging to the user.

DETAILED DESCRIPTION

The features of the present invention are set forth in the appended claims which may be best understood by reference to the following description taken in conjunction with the accompanying drawings.

Figure 1:
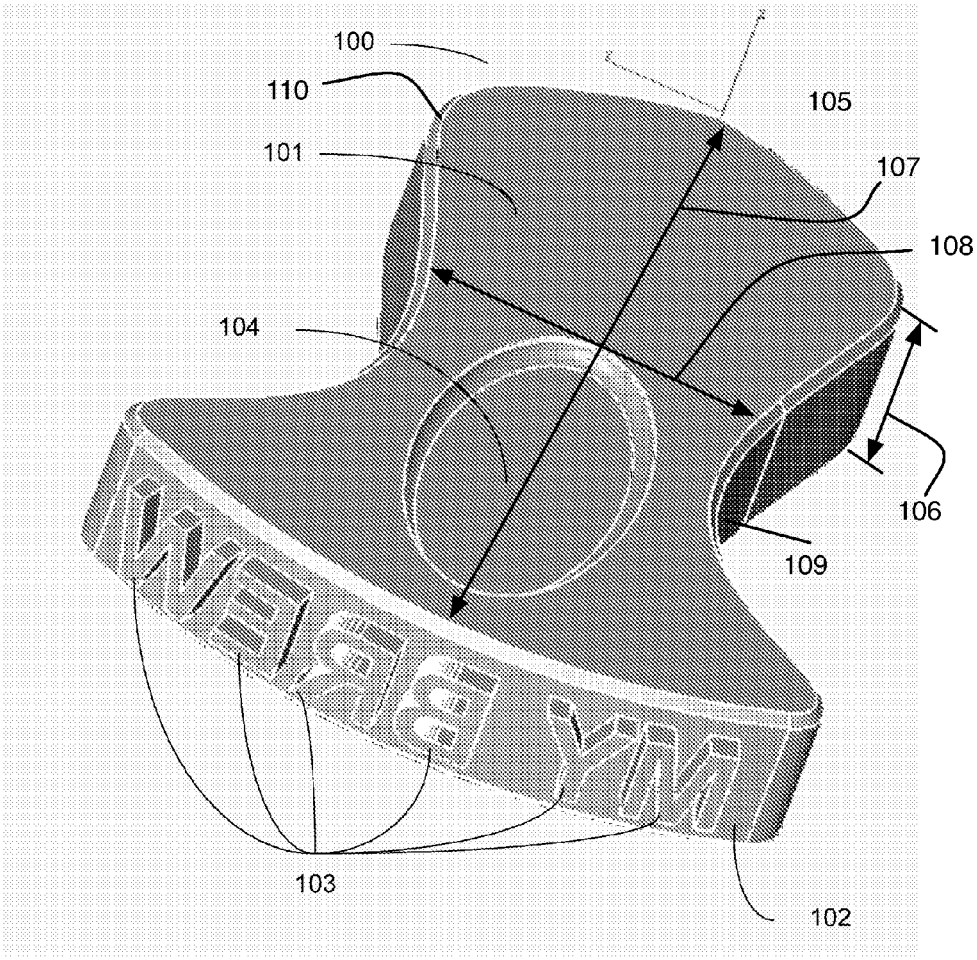
FIG. 1 shows a top isometric view of one embodiment of a stamping tool.
Figure 4:
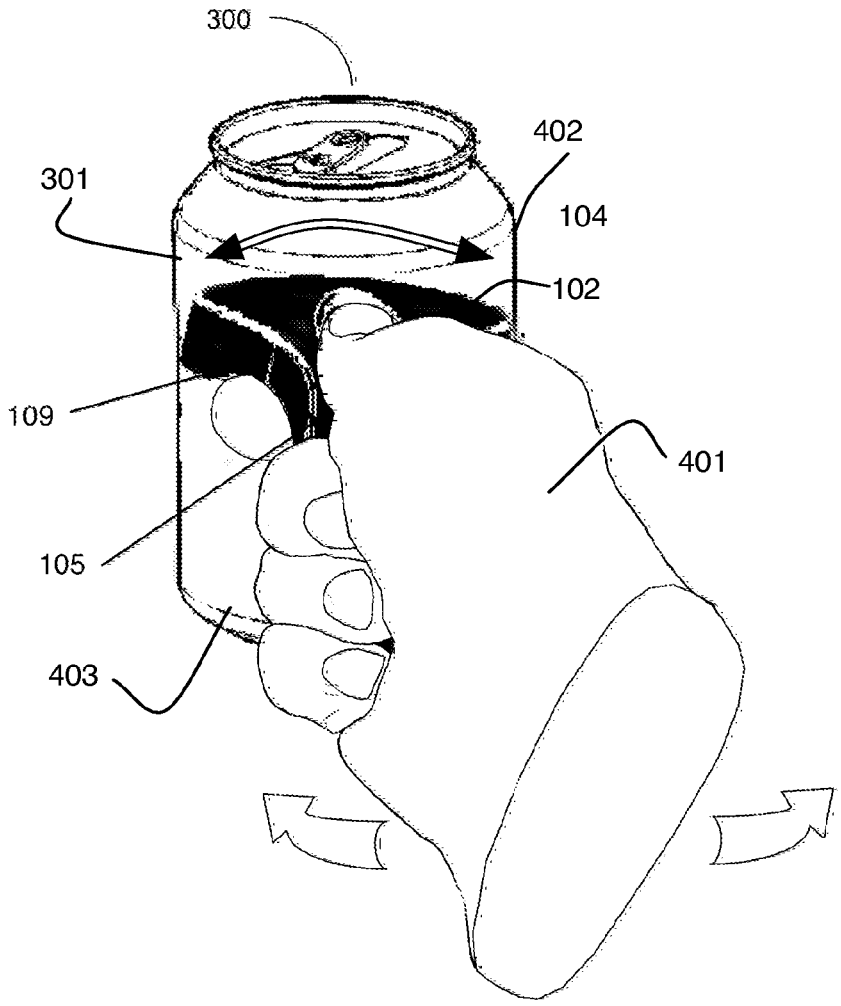
FIG. 4 shows the stamping tool of FIG. 1 being applied to the external surface of the metal container.

FIG. 1 depicts one embodiment of the stamping tool 100 wherein the custom identifier "MY BREW" appears in raised letters in mirror image 103 on the curved working face of the tool 102. The body of the tool 101 is flat and is shaped to fit against the heel of the user's hand. The top surface of the stamping tool incorporates an oval indentation 104 to provide a gripping point for the user's thumb and promote a firm grip on the tool during the stamping process. The curved working face 102 allows maximum manual pressure to be applied to the interface between the working face 102 and the surface of the container to ensure that a significant indentation occurs as each symbol is pressed against the container surface. In one embodiment the particular shape as shown in FIG. 1 is conducive to gripping and pressing the tool against a metal surface with enough force such that an indented image of the of the characters or symbols 103 on the face 102 of the tool is made on a metal or other malleable surface. The tool is a violin shaped object having a first end 105 and a second end 102. The working face of the tool is at the second end 102. The tool has a width 108 thickness 106 and a length 107 and the length 107 is substantially greater than the thickness 106. The width 108 varies across the length of the tool such that a waist 109 is created at a point between ½ to ⅔ of the distance between the first end 105 and the second end 102. The first end is an enlargement of the tool across its width that facilitates gripping of the tool in a user's palm as is shown in FIG. 4 below. In another embodiment (not shown) the enlargement of the tool at the first end 105 occurs in both the thickness and the width producing a bulbous grip at the first end 105. In this embodiment the edges 110 may be further rounded. In the embodiment shown the characters to be impressed by the tool are English characters. In another embodiment the characters are that of any other language. In another embodiment the characters are replaced by images. In another embodiment the images may be sports team logos. Although the remaining examples all show characters on the working surfaces it should be understood that any images, characters or symbols may be used in place of the characters as shown in the examples. The term images refers to all characters, symbols and images.

Figure 2:
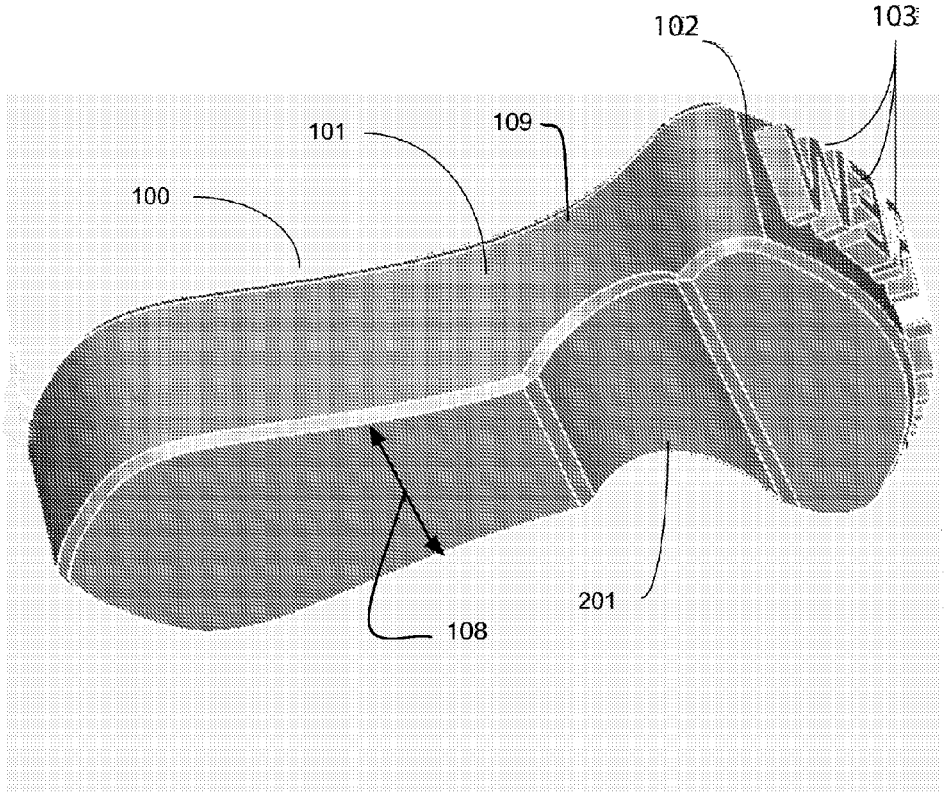
FIG. 2 shows a bottom isometric view of the tool shown in FIG. 1.

FIG. 2 shows a bottom isometric view of the embodiment shown in FIG. 1 and shows a finger slot 201 to further provide for a firm grip on the tool. The finger slot is a curved indentation that extends across the width 108 of the tool and is seen to align with the waist 109. The stamping tool 100 can be fabricated by injection molding either plastic or metal. A set of standard symbols (such as common first names or catchy phrases) can be incorporated into a set of molds. Alternatively, the custom symbols or characters can be formed by machining the working face 102 of a previously fabricated blank tool using, for example, a numerical milling machine.

Figure 3:
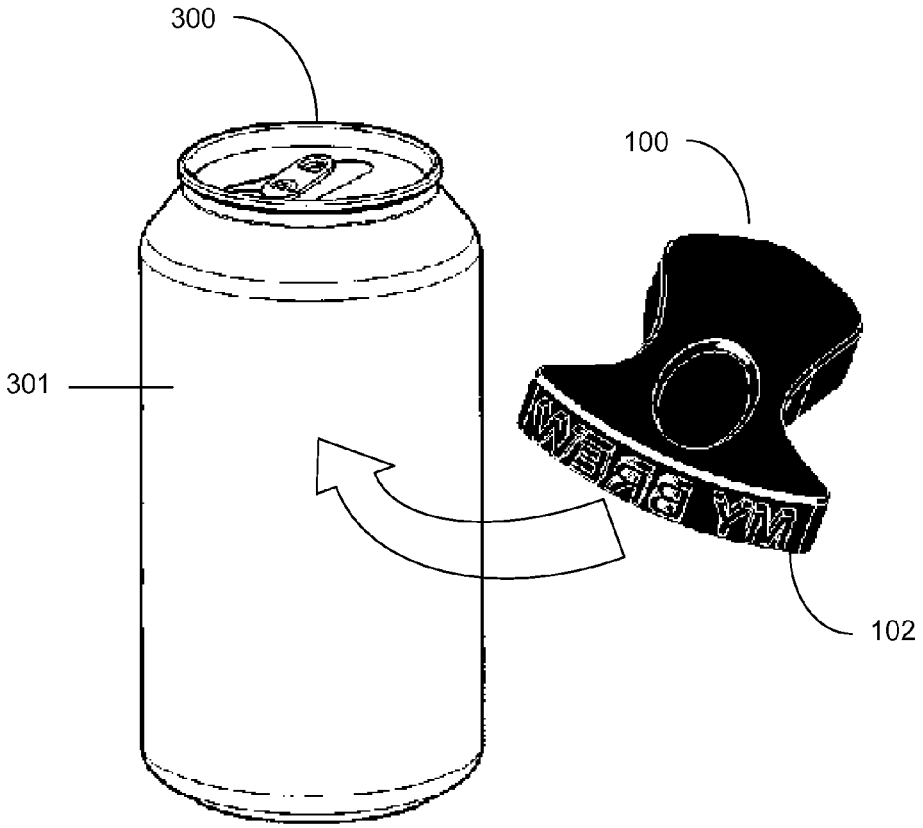
FIG. 3 shows the stamping tool shown in FIG. 1 near a metal container prior to application of the tool.

FIG. 3 shows the stamping tool 100 near a cylindrical metal container 300 prior to application of the tool to the external surface 301 of the container. FIG. 4 shows stamping tool 100 applied to the external surface of the container by a human hand 401 such that the entirety of the working face 102 of the tool comes in contact with the external surface 301 of the container as the tool is manually rolled over the surface of the container 300. Manual pressure is exerted on stamping tool 100 in order to deform the surface 301 of the container 300 as the curved working face 102 of the stamping tool is rolled along its length. The curved working face 102 allows the tool to be successfully applied to containers having a rectangular cross section as well as to cylindrical containers. The advantage of the shape of the tool is seen in how the features of the tool fit within the hand. The user's thumb is seen to fit in the depression 104 and the user's forefinger wraps around the tool at the waist 109. Although hidden by the user's hand, it is apparent that the enlarged first end (105 of FIG. 1) fits within the user's palm.

Another embodiment includes a method of imprinting a malleable object such as an aluminum drink can, the method including pressing against the can surface a tool that includes raised lettering with such force that the raised lettering creates an indentation in the surface of the drink can. In a preferred embodiment the tool is comprised of a handle formed to fit the hand of the user as already described and a curved surface upon which the raised lettering is located. The lettering consists of sharpened structures as more fully described in conjunction with FIG. 11. In a preferred embodiment of the method the lettering is applied near the upper edge 402 of the can where the structure allows application of pressure without crushing the can. The same is true of applying the lettering at the lower edge 403 of the can.

Figure 5:
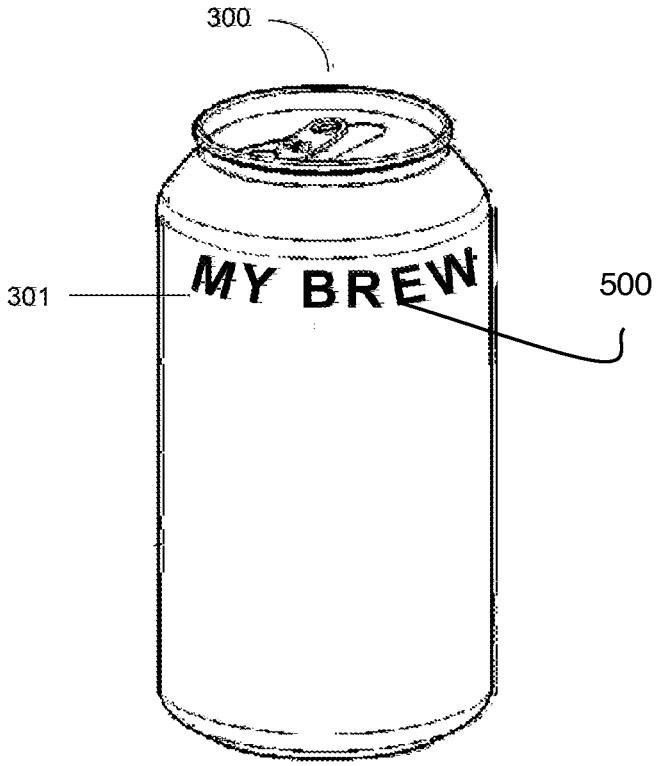
FIG. 5 shows the metal container displaying the stamped characters forming the identifier as applied using the stamping tool.

FIG. 5 shows the container 300 after application of the stamping tool 100 and shows that the custom identifier 500 has been transferred to indentations in the external surface 301 of the container 300.

Figure 6:
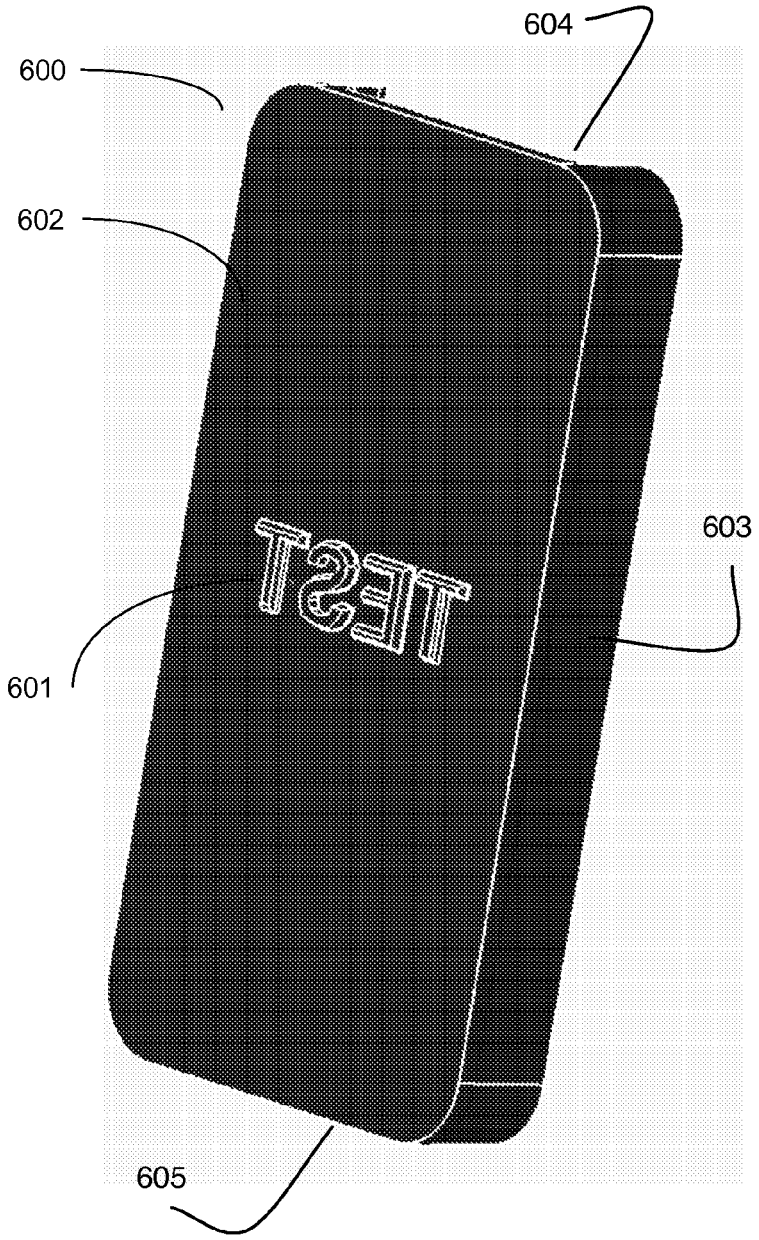
FIG. 6 shows a front isometric view of an embodiment of the stamping tool molded into a smart phone case.

FIG. 6 shows an embodiment of the stamping tool in which the symbols or characters of the custom identifier 601 are formed on the external surface 602 of a smart phone case 600. This embodiment can be fabricated by vacuum forming plastic sheets around a mold. Although the external working surface 602 of this embodiment of the tool is flat, it still allows the custom identifier 601 to be impressed into the curved surface of a cylindrical container by rolling the container beneath the working surface 602 while applying manual pressure to the tool. The cell phone case is comprised of a rectangular container having a back surface 602 that is in the embodiment shown also the working surface for the stamping tool. The back surface includes raised characters 601 that may be impressed on a malleable surface with hand pressure. The case further includes sides 603 a top 604 and a bottom 605. The view of the bottom is obstructed in the isometric view of FIG. 6. In another embodiment (not shown) the raised characters may be located on one or both sides, the top 604 or the bottom 605, making the sides, top and bottom working surfaces for the tool. In another embodiment the raised characters are located on a plurality of the surfaces. In the latter embodiment having a plurality of working surfaces there may be a plurality of characters with different characters on each surface.

Figure 7:
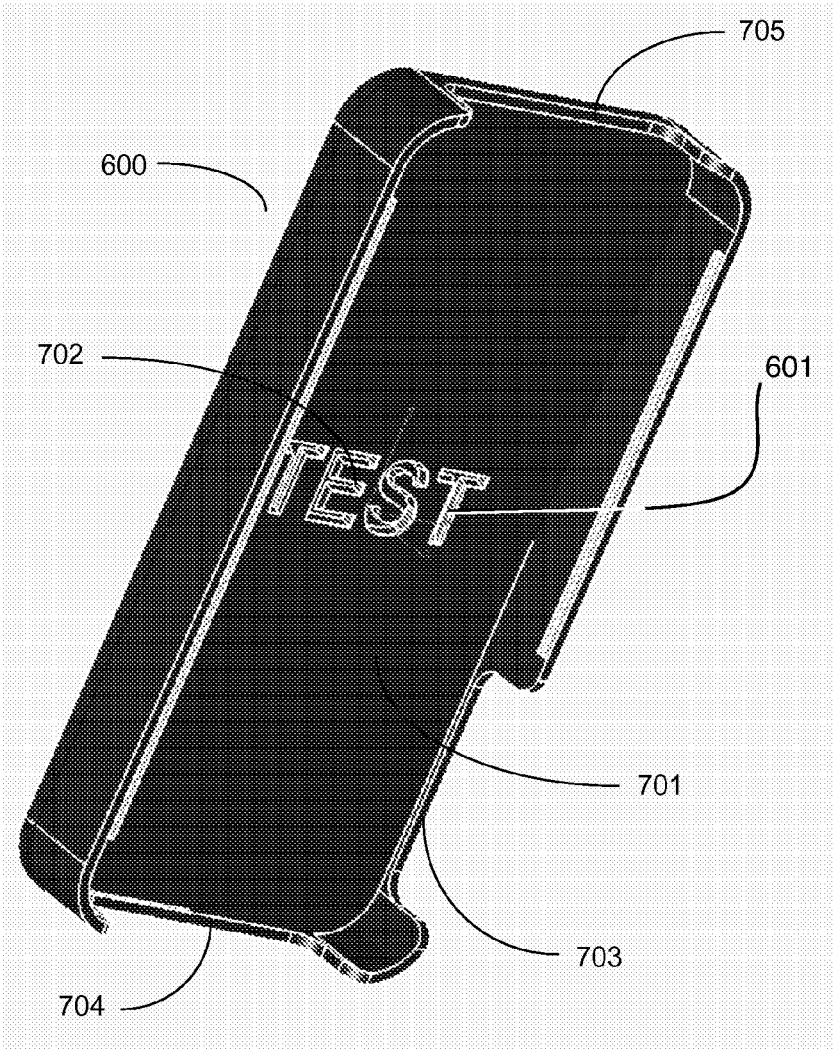
FIG. 7 shows a rear isometric view of the embodiment shown in FIG. 6.

FIG. 7 shows an isometric view of the interior of the case 600 showing the cavity 701 into which the smart phone is mounted and the concave inner surfaces 702 of the symbols or characters 601 which form around the original mold pattern. Case 600 also includes openings in the side walls 703-705 for access to connectors or buttons placed on the external surface of the smart phone.

Figure 8:
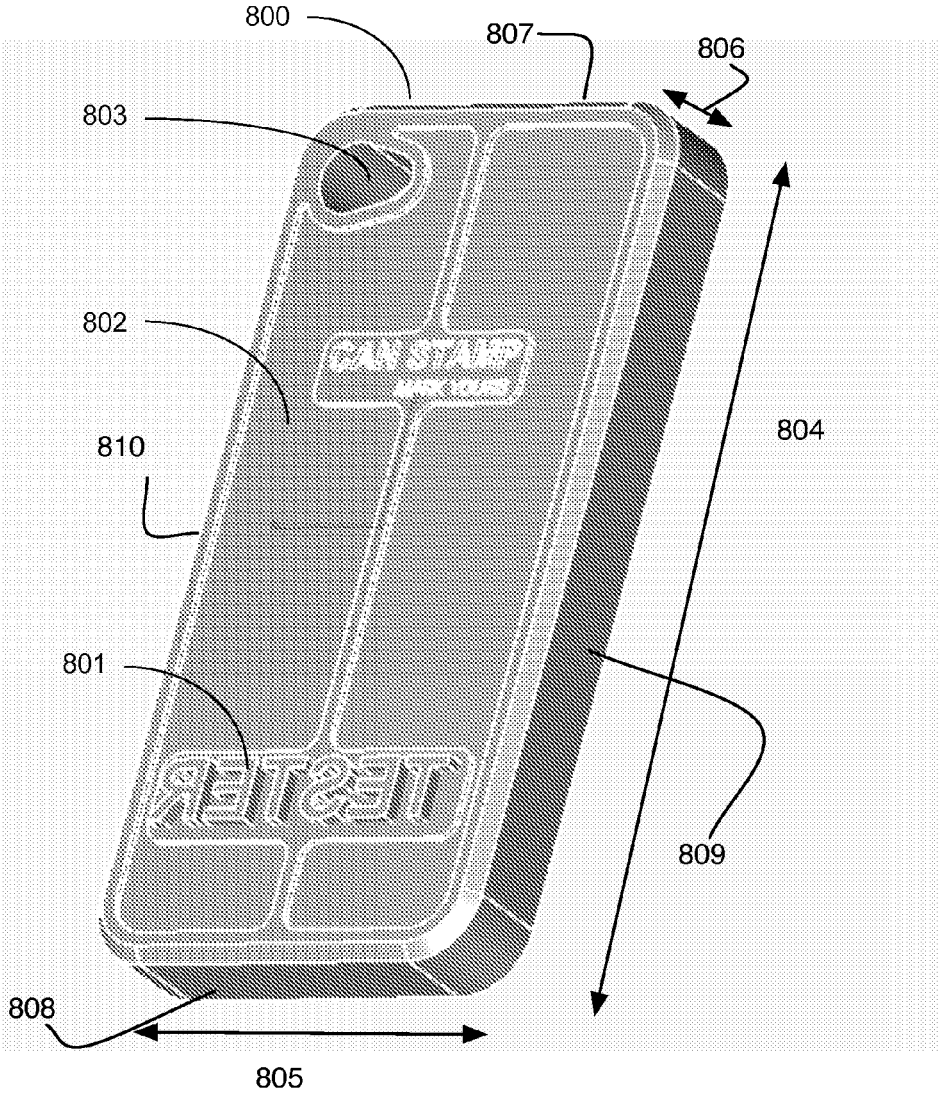
FIG. 8 shows a front isometric view of an embodiment of the stamping tool molded into a key ring fob.

FIG. 8 shows an embodiment of the stamping tool in which the symbols or characters of the custom identifier 801 are formed on the flat external surface 802 of a key fob 800. As for the embodiment shown in FIG. 1, the key fob stamping tool 800 can be fabricated by injection molding either plastic or metal. Alternatively, the custom symbols or characters can be formed by machining the working face 802 of a previously fabricated blank key fob using, for example, a numerical milling machine. Key fob embodiment 800 also includes a hole 803 for attachment to one or more keys using, for example, a chain or a split ring. The key fob embodiment is comprised of a rectangular box having a length 804, width 805 and thickness 806. The length is greater than the width 805 thereby forming a rectangle. In another embodiment the width and length are equal and the fob is square. The fob is further comprised of a front surface 802 a back surface not visible in the image, a top edge 807, a bottom edge 808, and side edges 809, 810. The latter side 810 is obscured in the view shown. The tool includes raised characters 801 that when pressed against a malleable object, form a mirror image of the raised characters. In another embodiment the raised characters may be placed on the back surface or any of the edges 807, 808, 809, 810. In another embodiment a plurality of images are placed on a plurality of the surfaces.

Figure 9:
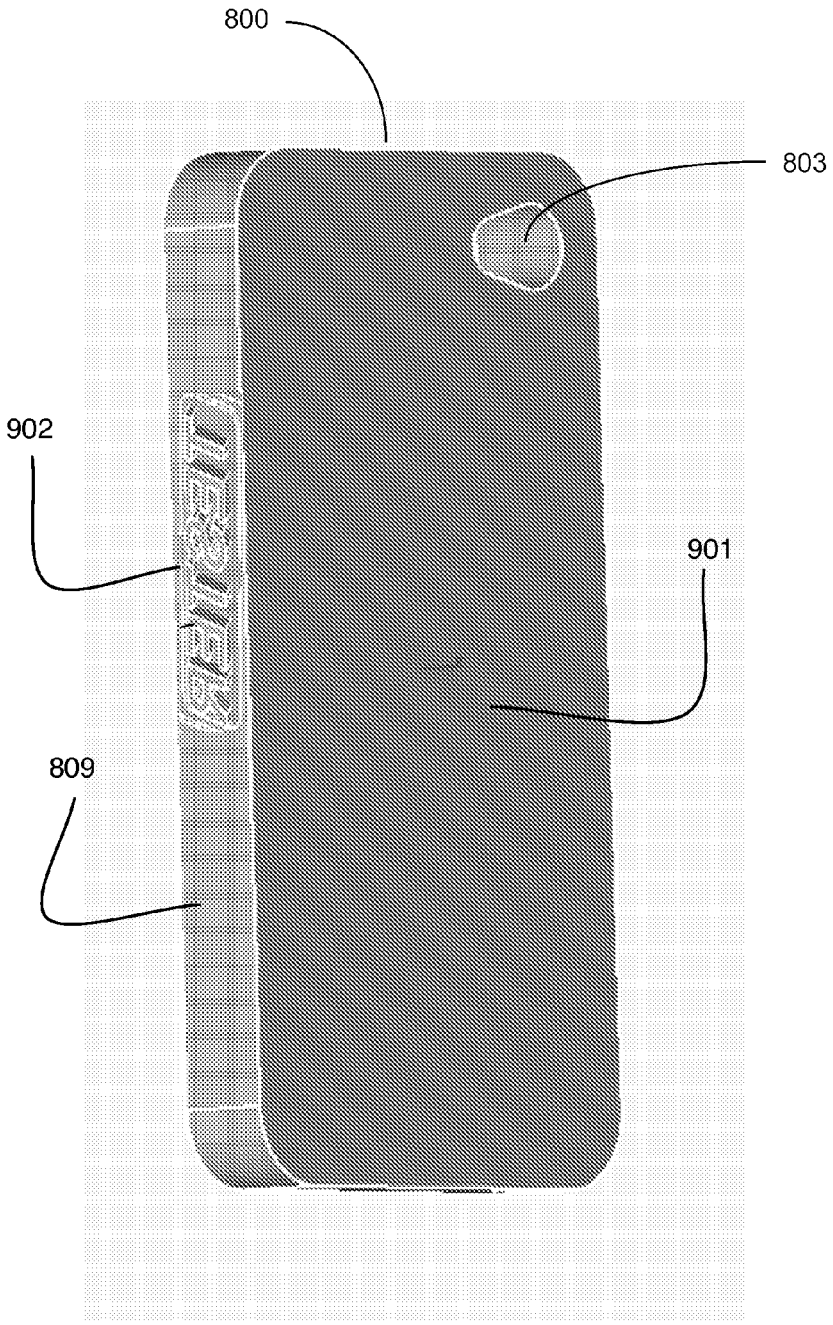
FIG. 9 shows a rear isometric view of the embodiment shown in FIG. 8.

FIG. 9 shows a rear isometric view of the key fob 800 which may include decorative finishes, user identification information and additional raised characters to produce another working surface. In the embodiment shown the fob further includes characters 902 along an edge 809 of the rectangular fob.

Figure 10:
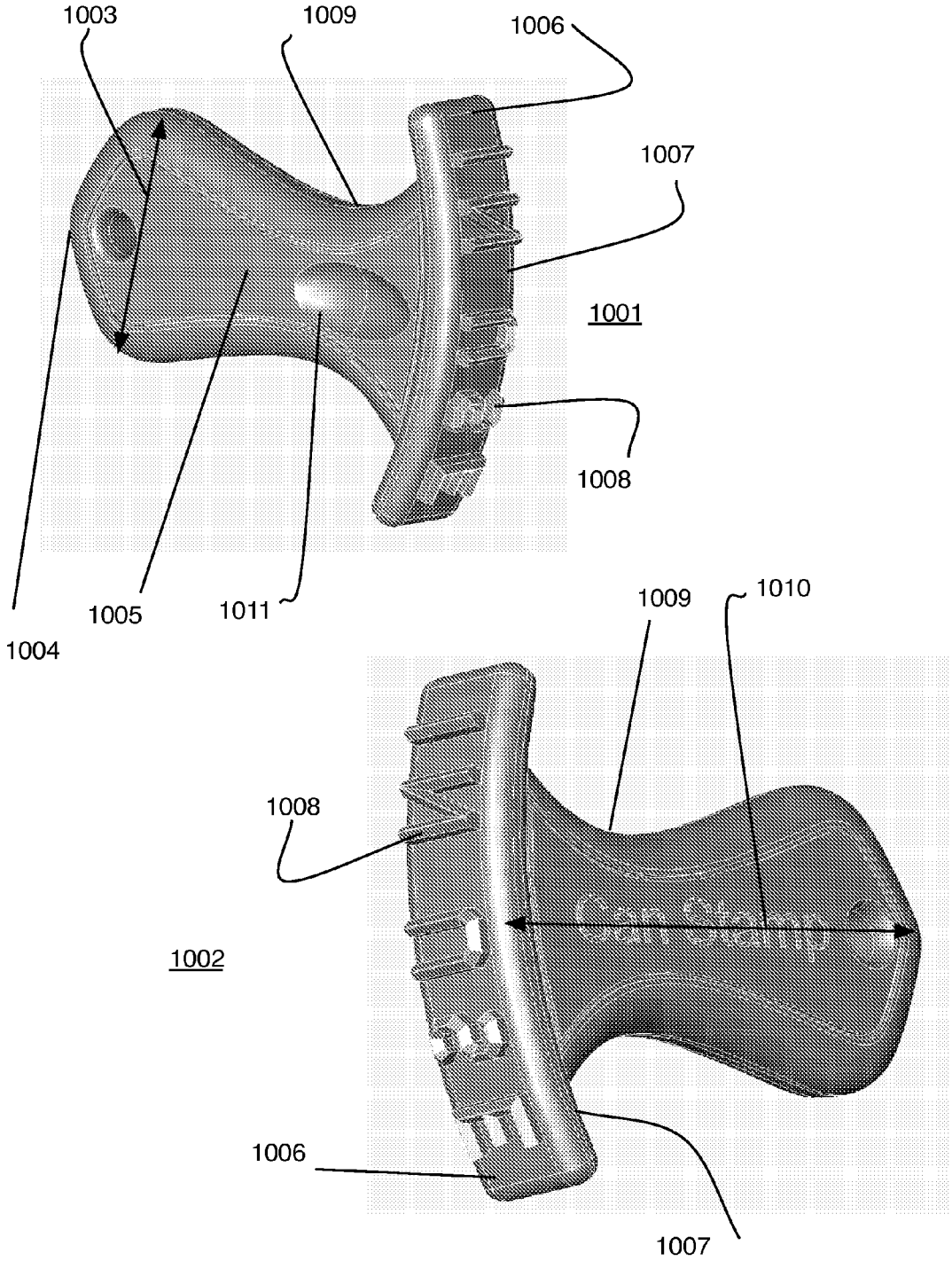
FIG. 10 shows front and back views of another embodiment.

In another embodiment shown in FIG. 10 a tool for marking malleable surfaces is shown. A top view 1001 and a bottom view 1002 of the tool are shown. The tool consists of an oblong body 1005 with a first end 1004 and a second end 1006. The first end 1004 has a width 1003 that gradually diminishes going towards the second end 1006 to form a waist 1009. The width of the tool increases slightly toward the second end after the waist. The second end 1006 includes a curved surface 1007 and upon the curved surface there is raised lettering 1008. In a preferred embodiment the lettering is a mirror image. In another embodiment (not shown) the lettering is replaced by a symbol or design. The tool further includes a depression 1011 seen in the front face view 1001 located such that a user may comfortably grip the tool with their thumb fitting in the depression and the width 1003 and length 1010 selected to fit within the palm of one hand much as described in FIG. 4.

Figure 11:
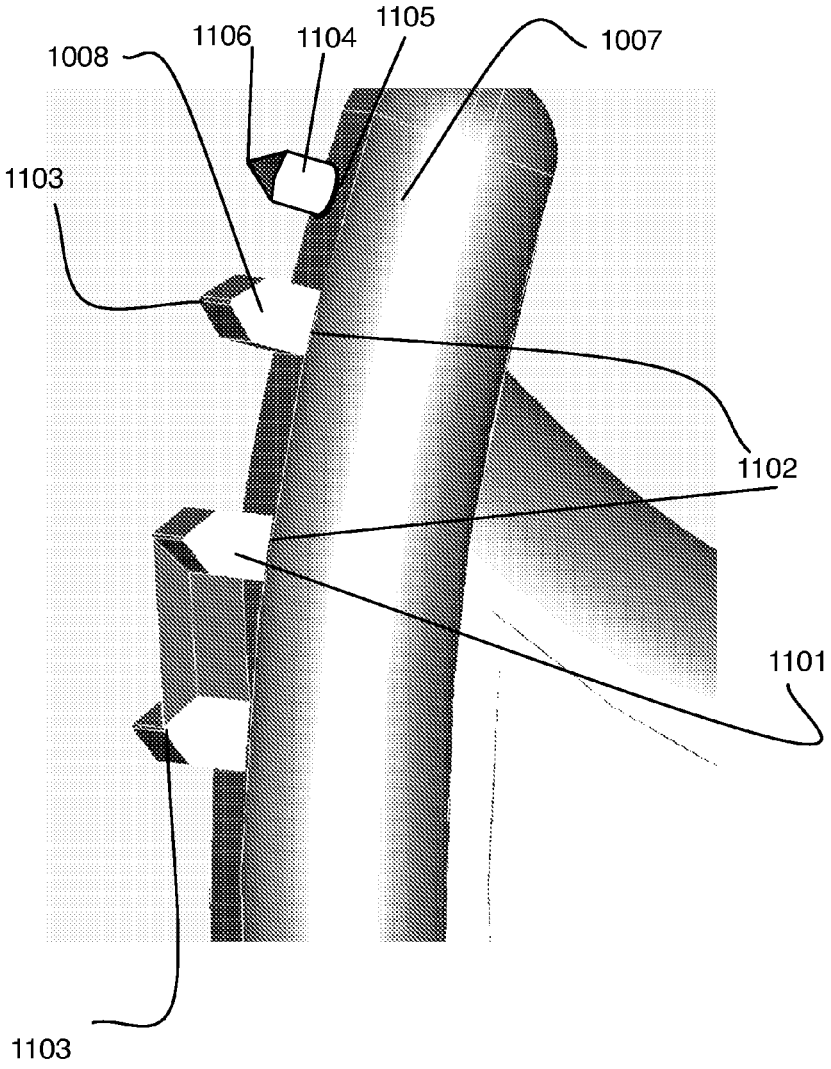
FIG. 11 shows a close up view of the imprinting characters.

Referring now to FIG. 11 a closer side view of the lettering 1008 of the device of FIG. 10 is shown. The lettering is comprised of a structure having a pentagonal cross-section 1101 with a flat side of the pentagon 1102 attached to the curved surface 1007 and an apex of the pentagon 1103 forming the contact point to imprint the lettering in a malleable surface. The shape of the raised features shown in FIG. 11 is applicable to embodiments of all the tools previously discussed. As before the raised features are not limited to lettering but can form symbols or any other images capable of being displayed through imprinted lines. In another embodiment the raised features comprise a cylinder 1104 with a flat base 1105 attached to the curved surface 1007 and a point 1106 at the end opposite the base. The point comprising the point of contact for making imprinted features.

Figure 12:
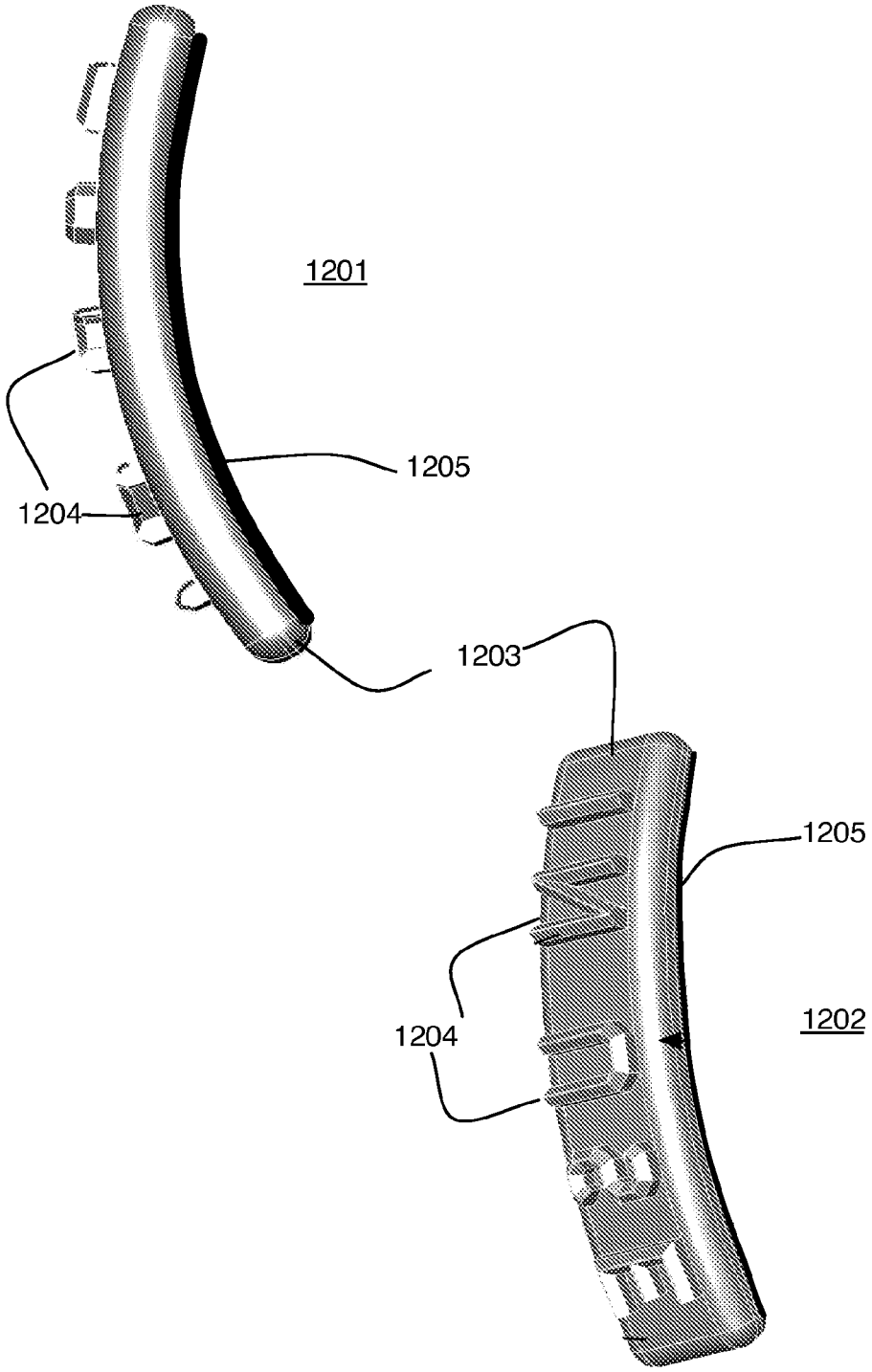
FIG. 12 shows a working face of an imprinting tool.

Referring now to FIG. 12, two views of a working face of an imprinting tools is shown. In the first side view 1201, the working face is comprised of a base 1203, raised lettering 1204 and a layer for attachment 1205 to the handle (not shown). In the second view 1202 a perspective view is shown to better see the lettering and attachment layer 1205.

The present invention has been described in terms of the preferred embodiment and it is recognized that equivalents, alternatives and modifications, beyond those expressly stated, are possible and are within the scope of the attached claims.

What is claimed is:

1. A tool for marking malleable surfaces with an image, said tool comprising:

a. a flat violin shaped object having a length, a width, a thickness, a first end and a second end, two side edges, a top surface and a bottom surface, b. a widened section at the first end sized to fit into the palm of the hand of a user, c. a curved working face at the second end, d. a raised relief of said image said raised relief being a mirror image of the image, e. a narrowing in the width at a point ½ to ⅔ of the distance from the first end to the second end thereby forming a waist, f. an oval indentation in the top surface at a location ½ to ⅔ of the distance from the first end to the second end, said indentation sized to accommodate a user's thumb, and, g. a channel cut across the width of the bottom surface at the approximate location of the waist, said channel sized to accommodate a user's forefinger.

2. The tool of claim 1 wherein the raised relief is comprised of a solid structure having a pentagonal cross-section with a flat edge of the pentagon attached to the working face and an apex of the pentagon forming a point of contact with the malleable surface.

3. A marking system for facilitating the visual discrimination of a container from other similar containers, said containers including a malleable surface, said marking system comprising:

a. a working face, said working face including an image, said image comprising a plurality of symbols arranged to create a raised relief of said image, said raised relief being a mirror image of the image, b. a stamping tool comprising a body portion fixably attached to the working face, wherein the body portion provides means for advantageously exerting a manual force on the working face against the malleable surface, c. wherein the raised symbols are each comprised of a solid structure having a pentagonal cross-section with a flat edge of the pentagon attached to the working face and an apex of the pentagon forming a point of contact with the malleable surface.

4. The marking system of claim 3 wherein the working face of the stamping tool is a curved surface.

5. The marking system of claim 3 wherein the working face of the stamping tool is a flat surface.

6. The marking system of claim 3 wherein the body of the stamping tool is a smart phone cover.

7. The marking system of claim 3 wherein the body of the stamping tool is a key fob.

8. The marking system of claim 4 wherein the body of the stamping tool is a smart phone cover.

9. The marking system of claim 4 wherein the body of the stamping tool is a key fob.

10. The marking system of claim 5 wherein the body of the stamping tool is a smart phone cover.

11. The marking system of claim 5 wherein the body of the stamping tool is a key fob.

* * * * *